US005340659A

United States Patent [19]

Horimura

[11] Patent Number: 5,340,659

[45] Date of Patent: Aug. 23, 1994

[54] HIGH STRENGTH STRUCTURAL MEMBER AND A PROCESS AND STARTING POWDER FOR MAKING SAME

[75] Inventor: Hiroyuki Horimura, Saitama, Japan

[73] Assignee: Honda Giken Kogyo Kabushiki Kaisha, Tokyo, Japan

[21] Appl. No.: 710,432

[22] Filed: Jun. 5, 1991

[30] Foreign Application Priority Data

Jun. 5, 1990 [JP] Japan ..... 2-146425

[51] Int. Cl.[5] ..... B22F 3/20

[52] U.S. Cl. ..... 428/567; 75/228; 419/67

[58] Field of Search ..... 428/546, 547, 548, 567; 419/67, 68; 75/228, 255

[56] References Cited

U.S. PATENT DOCUMENTS

| | | | |
|---|---|---|---|
| 4,647,321 | 3/1987 | Adam | 148/415 |
| 4,702,885 | 10/1987 | Odani et al. | 419/23 |
| 4,711,823 | 12/1987 | Shiina | 428/547 |
| 4,731,133 | 3/1988 | Dermarkar | 148/437 |
| 4,762,678 | 8/1988 | Dolgin | 419/28 |
| 4,853,179 | 8/1989 | Shiina | 419/28 |
| 4,867,806 | 9/1989 | Shiina | 148/11.5 |
| 4,889,582 | 12/1989 | Simon, Jr. et al. | 148/12.7 |
| 5,145,503 | 9/1992 | Horimura | 75/228 |

*Primary Examiner*—Donald P. Walsh
*Assistant Examiner*—Chrisman D. Carroll
*Attorney, Agent, or Firm*—Lyon & Lyon

[57] ABSTRACT

A high strength structural member formed in a forming process using a starting powder of a light alloy. The starting powder is a mixture of a crystalline phase main powder component and at least 5% by volume of an additional powder component which includes between 5% and 100% by volume of an amorphous phase of the light alloy powder and the balance of a crystalline phase.

11 Claims, 5 Drawing Sheets

HIGH STRENGTH STRUCTURAL MEMBER AND A PROCESS AND STARTING POWDER FOR MAKING SAME

BACKGROUND OF THE INVENTION

The present invention relates to a process for producing a high strength structural member and a starting powder of a light alloy for use in carrying out the process.

There is a conventionally known process for producing a structural member which comprises forming a green compact using a supersaturated solid solution powder (having a crystalline phase volume fraction C (Vf) of 100%) of a light alloy as a starting, powder for the purpose of providing an increased strength of the resulting member, and subjecting the green compact to a hot extrusion.

However, the above-described starting powder exhibits poor in moldability and in bondability between the particles thereof, resulting in a failure to produce a high strength member at lower working rates. For this reason, a large-sized apparatus must be used in order to provide a higher working rate. The employment of such a means causes a problem in that the production cost of the member is increased because of the increased equipment cost and the durability of the equipment is lower. Another problem is that if the green compact is subjected to a hot extrusion at a higher working rate, the metallographic structure to the resulting member becomes fibrous and it is difficult of provide a homogeneous metallographic structure.

SUMMARY OF THE INVENTION

Accordingly, it is an object of the present invention to provide a process of the type described above wherein an increase in strength of the member can be achieved even at a lower working rate by use of a unique starting powder.

The present invention provides a high strength structural member and a process for producing that high strength structural member, comprising the steps of preparing a mixed powder as a starting powder of a light alloy, which contains a main powder component and an additional powder component and has a volume fraction P (Vf) of the additional powder component of at least 5%, the main powder component comprising a crystalline phase alloy powder having a crystalline phase volume fraction C (Vf) substantially equal to 100%, the additional powder component comprising at least one of either a mixed phase alloy powder including a crystalline phase and an amorphous phase and having an amorphous phase volume fraction A (Vf) of at least 5% or a single amorphous phase alloy powder having an amorphous phase volume fraction A (Vf) of 100%, and subjecting the starting powder to a forming.

The present invention also provides a starting powder of a light alloy for use in production of a high strength structural member, the starting powder being a mixed powder containing a main powder component and an additional powder component and having a volume fraction P (Vf) of the additional powder component of at least 5%, the main powder component comprising a crystalline phase alloy powder having a crystalline phase volume fraction C (Vf) substantially equal to 100%, the additional powder component comprising at least one of either a mixed-phase alloy powder including a crystalline phase and an amorphous phase and having an amorphous phase volume fraction A (Vf) of at least 5% or a single amorphous phase alloy powder having an amorphous phase volume fraction A (Vf) of 100%.

In the above producing process, the inclusion of the amorphous phase of a volume fraction A (Vf) of 5% or more in the mixed-phase alloy powder as the additional powder component means that a powder skin layer of the mixed-phase alloy powder is formed of only an amorphous phase due to a powder producing process.

The amorphous phase generates the migration of atoms during crystallization, and, therefore, the mixed-phase alloy powder is good in moldability and in bondability between particles thereof even at relatively low working rates. By effectively utilizing such physical properties, it is possible to improve the moldability of the starting powder at a low working rate and to sufficiently bond particles of the main powder component with one another through particles of the mixed-phase alloy powder to provide an increase in strength of the resulting member. The same is true when a single amorphous phase alloy powder is used as the additional powder component.

If a starting powder of the above-described type is used, the producing process can be carried out efficiently. It is preferable that the compositions of the alloys for the main and additional powder components be identical or approximate to each other.

If the volume fraction P (Vf) of the additional powder component in the starting powder is less than 5%, the resulting member will have a reduced strength and a small elongation, and, therefore, such a volume fraction is not preferred.

BRIEF DESCRIPTION OF THE DRAWINGS

The invention will now be described in connection with several embodiments and variations thereof, with reference to the accompanying drawings, wherein.

DETAILED DESCRIPTION OF THE PREFERRED EMBODIMENTS

For purposes of illustrating the scope of this invention, a molten metal of an aluminum alloy having a composition of $Al_{92}Fe_5Y_3$ (in which each of the numerical values represents an atom %) was prepared and used to produce mixed-phase alloy powders $P_1$ to $P_4$ and a crystalline phase alloy powder $P_5$ with various diameters by utilizing a conventional high pressure helium (He) gas atomization process. Table I shows metallographic structures and diameters of the alloy powders $P_1$ to $P_5$.

TABLE I

| Alloy Powder | Diameter (μm) | Volume fraction A of amorphous phase (Vf) (%) | Volume Fraction C of Crystalline phase (Vf) (%) |
|---|---|---|---|
| $P_1$ | <22 | 50 | 50 |
| $P_2$ | 22–26 | 25 | 75 |
| $P_3$ | 26–32 | 10 | 90 |
| $P_4$ | 32–44 | 5 | 95 |

TABLE I-continued

| Alloy Powder | Diameter (μm) | Volume fraction A of amorphous phase (Vf) (%) | Volume Fraction C of Crystalline phase (Vf) (%) |
|---|---|---|---|
| $P_5$ | 44–63 | <1 | = 100 |

FIGS. 1*a* to 1*e* are X-ray diffraction patterns of the alloy powders $P_1$ to $P_5$, respectively. As is apparent from a comparison of FIGS. 1*a* to 1*e*, the number of peaks increases with the increasing percentage of the crystalline phase.

Figure 1A:
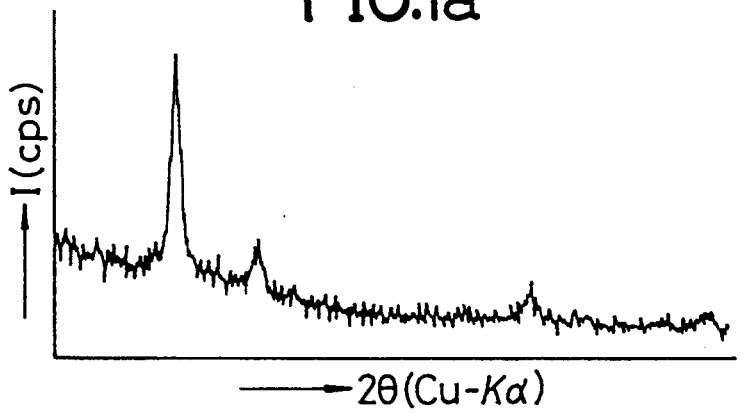
FIGS. 1*a* through 1*e* are x-ray diffraction patterns of various alloy powders.
Figure 1B:
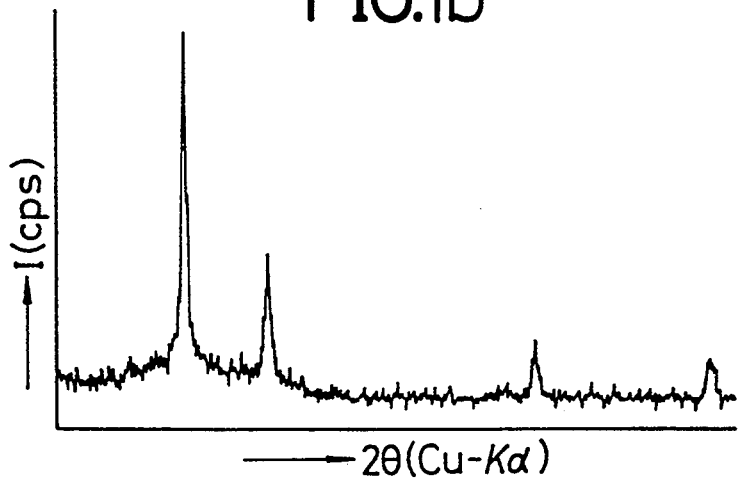
Figure 1C:
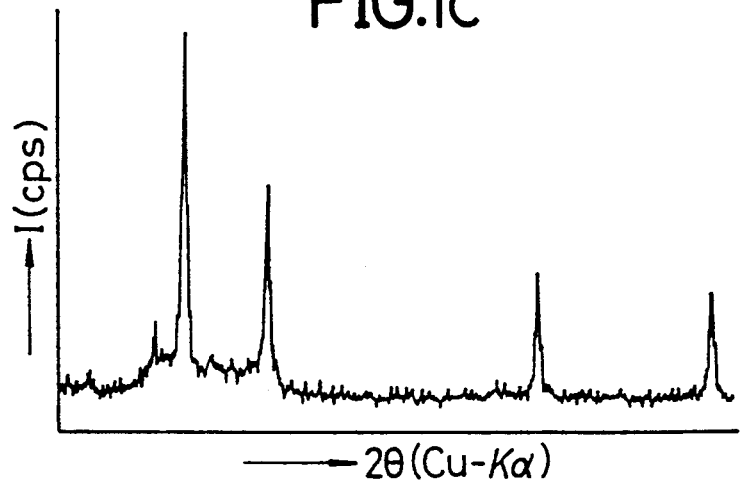
Figure 1D:
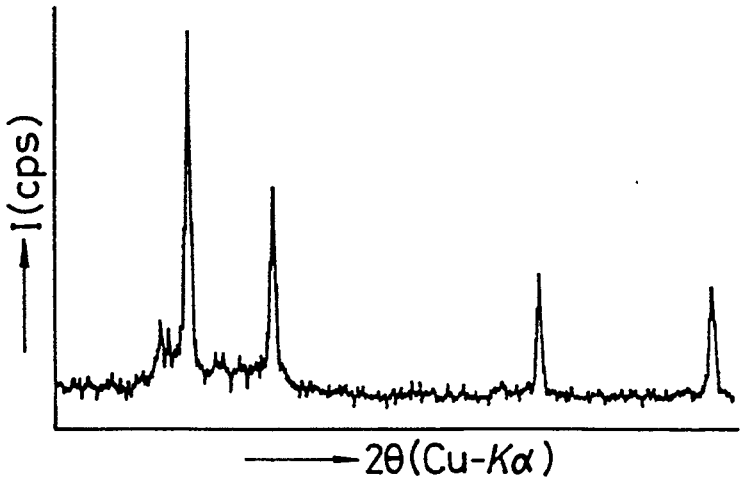
Figure 1E:
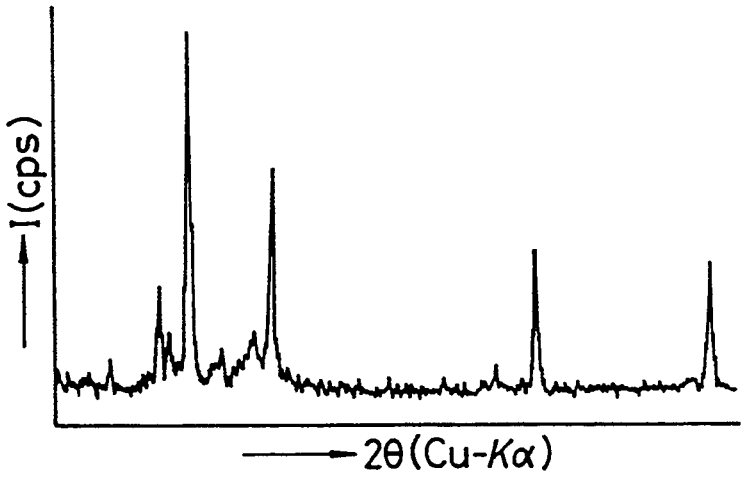
Figure 2A:
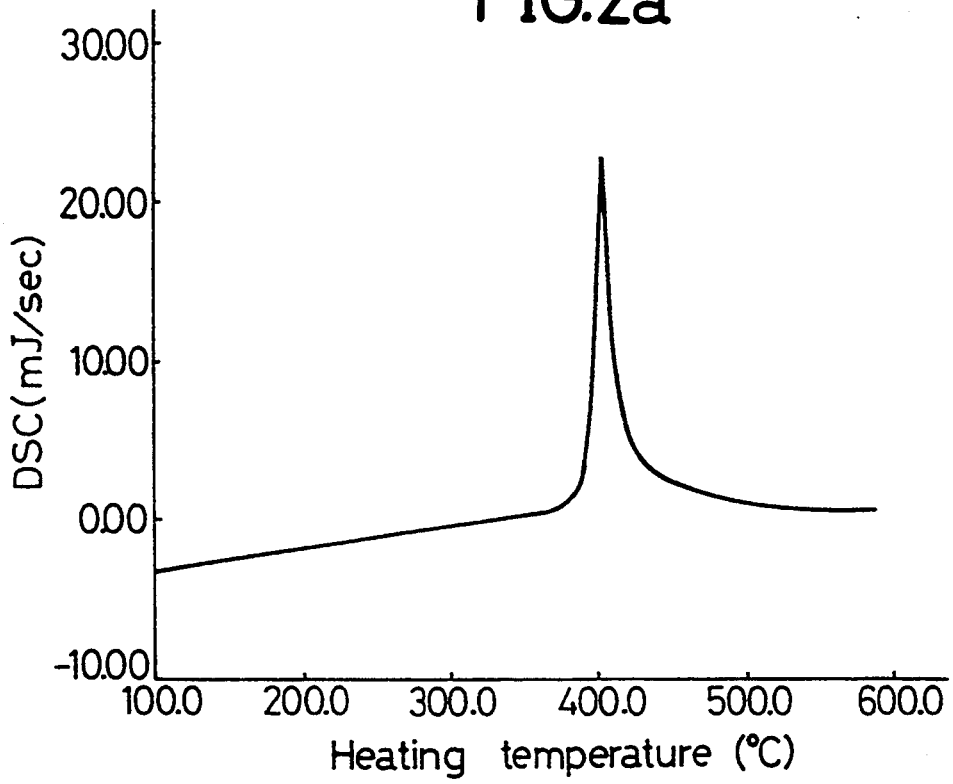
FIGS. 2*a* and 2*b* are thermocurves resulting from the differential thermal analysis of the various alloy powders.
Figure 2B:
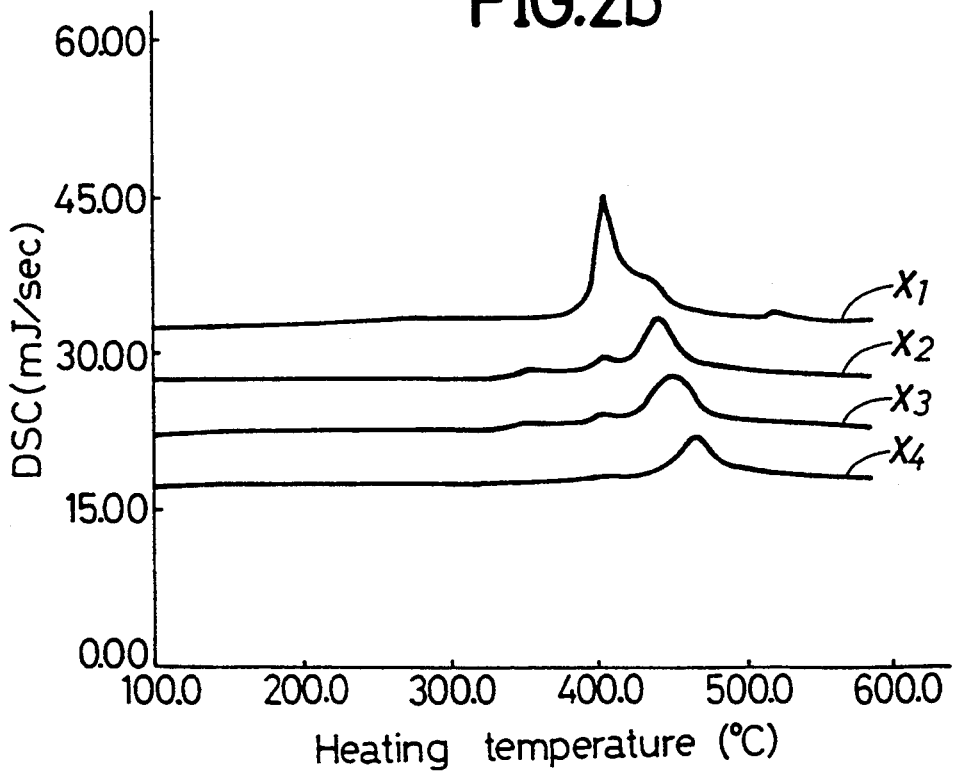

FIGS. 2*a* and 2*b* are thermocurves resulting from the differential thermal analysis for the alloy powders $P_1$ to $P_5$, wherein FIG. 2*a* corresponds to the mixed-phase alloy powder $P_1$ and in FIG. 2*b*, lines $x_1$ to $x_3$ correspond to the mixed-phase alloy powders $P_2$ to $P_4$, respectively, and line $x_4$ corresponds to the crystalline phase alloy powder $P_5$.

In each of the alloy powders $P_1$ to $P_5$, the temperature at which the maximum exothermic peak is generated with crystallization is as given in Table II, and, as is apparent from Table II, it can be seen that such temperature is raised with the increasing percentage of the volume fraction C (Vf) of the crystalline phase.

TABLE II

| Alloy Powder | Temperature (°C.) |
|---|---|
| $P_1$ | 400.0° C. |
| $P_2$ | 406.1° C. |
| $P_3$ | 443.7° C. |
| $P_4$ | 454.2° C. |
| $P_5$ | 471.9° C. |

Several mixed powders comprising the mixed-phase alloy powders $P_1$–$P_4$ of a predetermined volume fraction P (Vf) (as additional powders) and the crystalline phase powder $P_5$ (as a main powder) were provided as a starting material. In addition, the crystalline phase alloy powder $P_5$ was used alone as a starting material for comparison. A green compact of each of these starting powders was subjected to a forming process under heating and pressing conditions to produce structural members. In the present embodiment, the forming process used was a hot extrusion.

Figure 3A:
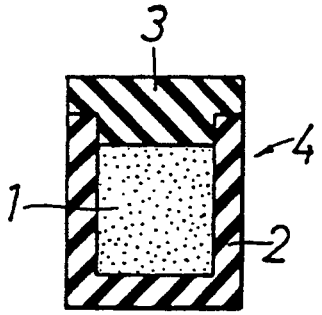
FIGS. 3*a* through 3*d* are diagrams illustrating the of a structural member of this invention.
Figure 3B:
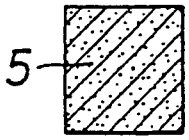
Figure 3C:
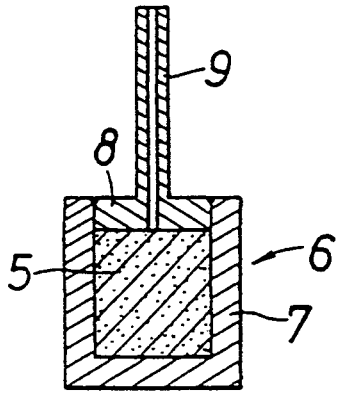
Figure 3D:
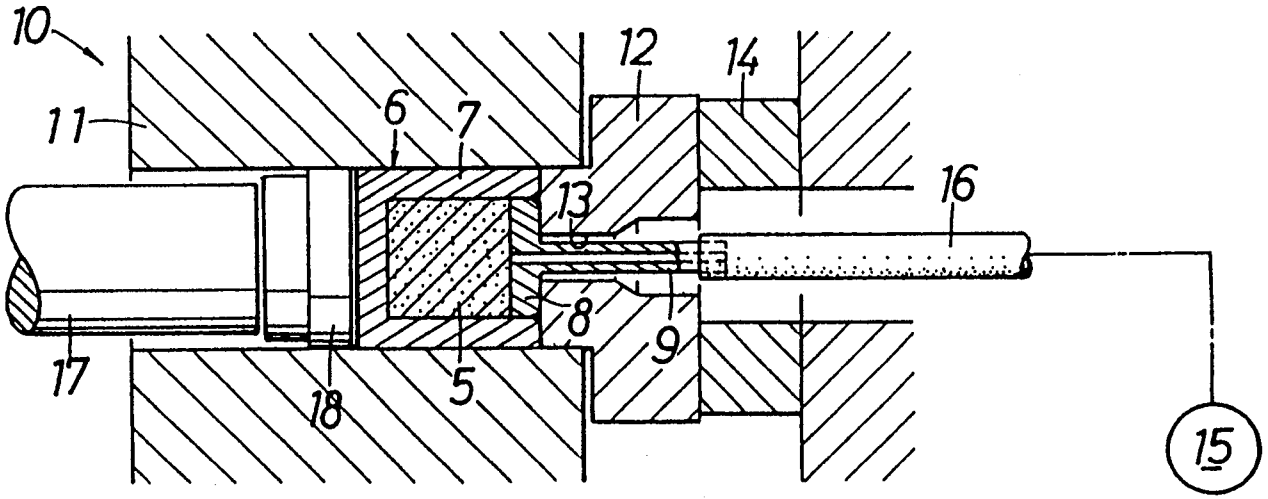

The procedure used for producing each structural member, as shown in FIGS. 3*a*–3*d*, was as follows:

i) As shown in FIG. 3*a*, a starting powder 1 was placed into a cylindrical rubber container 4 comprising a body 2 and a lid 3 and then subjected to a cold isostatic pressing (CIP) under a condition of a pressure of 4,000 kg f/cm$^2$.

ii) As shown in FIG. 3*b*, a short columnar green compact 5 having a diameter of 58 mm, a length of 40 mm and a density of 87% was produced by such cold isostatic pressing.

iii) As shown in FIG. 3*c*, the green compact 5 was placed in another cylindrical container 6 made of an aluminum alloy (AA specification 6061 material). The container 6 is comprised of a body 7 having an outside diameter of 78 mm and a length of 70 mm and a lid 8 welded to an opening in the body 7, with the lid 8 having a vent pipe 9 permitting communication between the inside and outside of the body 7.

iv) As shown in FIG. 3*d*, the green compact 5 was placed together with the container 6 into the bore of the body 11 of a single action type hot extruder 10, with the vent pipe 9 extending into a die packer 14 through a die bore 13 in a die 12. In the hot extruder 10, the maximum pressing force was set at 500 tons; the inside diameter of the bore in body 11 was equal to 80 mm and the preheating temperature of the extruder body 11 was 400° C. Then, a vacuum pump 15 was connected to the vent pipe 9 through a rubber pipe 16 to depressurize the inside of the container 6. At the point in time when the degree of vacuum exceeded $10^{-5}$ Torr, a stem 17 was advanced to apply a load of about 120 tons to the container 6 through a dummy block 18. This caused the container 6 to be deformed into close contact with the bore in extruder body 11, so that the temperature of the green compact 5 was rapidly raised and reached 400° C. in about 7 minutes.

The gas contained in the green compact 5 was expelled therefrom by the heating and depressurizing action, with the result that the degree of vacuum in the container 6 was reduced, but returned to a condition of a degree of vacuum exceeding $10^{-5}$ Torr after a lapse of about 10 minutes after the temperature of the green compact 5 reached 400° C.

The retention time at this temperature depends upon the density, composition, structure and the like of the green compact 5 and may be set in a range of from one minute to two hours. In this example of production, when the degree of vacuum in the container 6 returned to $10^{-5}$Torr, the green compact 5 was extruded together with the container 6, so that powder particles were bonded with one another, thereby providing a round bar-like structural member.

Table III shows the producing conditions for the structural members I to IX and the physical properties thereof. $P_1$ to $P_4$ are the mixed-phase alloy powders, and $P_5$ is the crystalline phase alloy powder. The numerical values added to the alloy powders $P_1$ to $P_5$ represent volume fractions (Vf) of alloy powders $P_1$ to $P_5$ in the starting powder, respectively.

TABLE III

| | Producing Conditions | | | Structural Member | |
|---|---|---|---|---|---|
| S.M. No. | Starting Powder P (Vf), (%) | D.B.D. (mm) | E. Pre. (kg f/mm$^2$) | Ten. Stre. (kg f/mm$^2$) | Elon. (%) |
| I | 100% P | 25 | 83 | 48.5 | 0 |
| II | 80% $P_5$ + 20% $P_1$ | 25 | 70 | 85.2 | 8.9 |
| III | 80% $P_5$ + 20% $P_2$ | 25 | 68 | 84.9 | 7.8 |
| IV | 80% $P_5$ + 20% $P_3$ | 25 | 72 | 84.3 | 8.6 |
| V | 80% $P_5$ + 20% $P_4$ | 25 | 67 | 85.5 | 9.0 |
| VI | 90% $P_5$ + 10% $P_4$ | 25 | 70 | 84.9 | 8.3 |
| VII | 95% $P_5$ + 5% $P_4$ | 25 | 73 | 74.0 | 5.2 |
| VIII | 97% $P_5$ + 3% $P_4$ | 25 | 81 | 56.1 | 0.6 |
| IX | 100% $P_5$ | 20 | 98 | 83.0 | 9.7 |

The abbreviations used in Table III and their meanings are as follows:

S.M. No.=Structural member No.

D.B.D.=Die bore diameter

E.Pre.=Extruding pressure

Ten. Stre.=Tensile strength

Elon.=Elongation

In Table III, the structural members II to VII are those produced according to the present invention. It can be seen from Table III that any of the members II to VII have a higher strength and a larger elongation than members I or VIII. Severe conditions, such as cooling rate, are imposed in order to produce an alloy powder containing an amorphous phase and therefore, such alloy powder is higher in cost. In the present invention, however, such an alloy powder may be used in a relatively small amount, leading to an increased economy.

It is believed that the reason the structural members II to VII have excellent physical properties as described above is as follows. The inclusion of an amorphous phase of a volume fraction A (Vf) of 5% or more in each of the mixed-phase alloy powders $P_1$ to $P_4$ means that a skin layer of each of the alloy powders $P_1$ to $P_4$ is formed of only an amorphous phase due to the producing process thereof. Such amorphous phase generates the migration of atoms with crystallization, and, hence, the mixed-phase alloy powders $P_1$ to $P_4$ are good in moldability and bondability at a powder interface even with a relatively low extrusion ratio (about 9.7). By effectively utilizing such physical properties, it is possible to improve the moldability of the starting powder, even with a lower extrusion ratio. It is also possible to sufficiently bond particles of the crystalline phase alloy powder $P_5$ with one another through particles of the mixed-phase alloy powders $P_1$ to $P_4$ to provide an increase in strength of each of the members II to VII. The same is true when a single amorphous phase alloy powder having an amorphous phase volume fraction A (Vf) of 100% is used as the additional powder, although this is not set forth as an example in Table III.

With the structural members I and VIII, a larger extruding pressure is required than with the members II to VII and in addition, the strength thereof is lower and the elongation thereof is small, due to the volume fractions of the mixed-phase alloy powder $P_4$ being less than 5%.

To produce a member having physical properties equivalent to those of the above-described members II to VII by use of only the crystalline phase alloy powder $P_5$, it is necessary to reduce the die bore diameter to increase the extrusion ratio to about 15, and a larger extruding pressure is required. Structural member IX of Table III is an example of such a process for comparison with the embodiments of the present invention.

In addition to $Al_{92}Fe_5Y_3$ that was used in the foregoing examples, the compositions of the starting powders which may be used in the present invention include $Al_{858}Ni_5Y_{10}$, $Al_{84}Ni_{10}Ce_6$, $Al_{84}Ni_{10}Dy_6$, $Al_{85}Ni_5Y_8Co_2$, $Al_{85}Fe_{7.5}Y_{7.5}$, $Al_{80}Ni_{10}Ca_{10}$, $Mg_{82}Ni_8Y_{10}$, $Mg_{76}Ni_{10}Ce_{10}Cr_4$, $Al_{83}Ni_5Y_{10}B_2$, $Al_{83}Ni_5Y_{10}Nb_2$, $Al_{88}Ni_6Ca_6$, $Al_{90}Ni_7Y_3$, $Al_{91}Fe_6Y_3$, $Mg_{85}Ni_8Ce_7$, $Mg_{86}Ni_6Y_8$ and the like (each of the numerical values representing an atom %).

According to the present invention, it is possible to produce a high strength structural member even at a lower than normal working rate by using a starting powder as described above and a procedure including subjecting such starting powder to a forming process.

What is claimed is:

1. A process for producing a structural member, comprising the steps of:

preparing a mixed powder as a starting powder of an Al or Mg alloy, which mixed powder contains a main powder component and an additional powder component with a volume fraction P (Vf) of the additional powder component of 5% to 20%, said main powder component comprising a crystalline phase alloy powder having a crystalline phase volume fraction C (Vf) substantially equal to 100%, said additional powder component comprising at least one of either a mixed-phase alloy powder including a crystalline phase and an amorphous phase with an amorphous phase volume fraction A (Vf) of at least 5%, or a single amorphous phase alloy powder with an amorphous phase volume fraction A (Vf) of 100%, and subjecting said staring powder to a forming process.

2. A starting powder of an Al or Mg alloy for use in production of a structural member, said starting powder being a mixed powder containing a main powder component and an additional powder component with a volume fraction P (Vf) of the additional powder component of 5% to 20%, said main powder component comprising a crystalline phase alloy powder with a crystalline phase volume fraction C(Vf) substantially equal to 100%, said additional powder component comprising at least one of either a mixed-phase alloy powder including a crystalline phase and an amorphous phase with an amorphous phase volume fraction A (Vf) of at least 5% or a single amorphous phase alloy powder with an amorphous phase volume fraction A (Vf) of 100%.

3. A structural member, comprising, a starting powder formed into the member by a forming process, the starting powder having a main powder component and an additional powder component with a volume fraction P (Vf) of the additional powder component of 5% to 20%, said main powder component comprising a crystalline phase alloy powder with a crystalline phase volume fraction C (Vf) substantially equal to 100%, said additional powder component comprising an amorphous phase with a volume fraction A (Vf) of between 5% and 100% and the balance of a crystalline phase.

4. The process of claim 1, wherein the volume fraction A(Vf) of the amorphous phase in the additional powder component is between 5% and 50%.

5. The starting powder of claim 2, wherein the volume fraction A (Vf) of the amorphous phase in the additional powder component is between 5% and 50%.

6. The member of claim 3, wherein the volume fraction A (Vf) of the amorphous phase in the additional powder component is between 5% and 50%.

7. The process of claim 1, wherein the forming process includes hot extrusion of the starting powder.

8. The member of claim 3, wherein the forming process includes hot extrusion of the starting powder.

9. The process of claim 1, wherein each of the particles of said additional powder component has a skin layer made of only an amorphous phase and said forming step includes bonding particles of said main powder component with one another through particles of said additional powder component while utilizing migration of atoms with crystallization generated at the skin layer of each particle of the additional powder component.

10. The starting powder of claim 2, wherein said mixed-phase alloy powder in the additional powder component has its amorphous phase volume fraction A (Vf) determined such that each particle of said mixed-phase alloy powder has a skin layer made of only an amorphous phase.

11. The structural member of claim 3, wherein the volume fraction A (Vf) of the amorphous phase in said additional powder is set to provide each particle of said additional powder component, at a minimum, a skin layer made of only an amorphous phase.

* * * * *

UNITED STATES PATENT AND TRADEMARK OFFICE

CERTIFICATE OF CORRECTION

PATENT NO. : 5,340,659
DATED : August 23, 1994
INVENTOR(S) : Horimura

It is certified that error appears in the above-indentified patent and that said Letters Patent is hereby corrected as shown below:

Column 6, line 5, delete "staring" and insert — starting —.

Signed and Sealed this

Sixth Day of December, 1994

*Attest:*

Bruce Lehman

BRUCE LEHMAN

*Attesting Officer*

*Commissioner of Patents and Trademarks*